United States Patent [19]

Ericsson

[11] 4,372,093

[45] Feb. 8, 1983

[54] TRUSS OF LATTICE TYPE

[75] Inventor: Axel B. R. Ericsson, Holmsund, Sweden

[73] Assignee: Frelena AB, Umeå, Sweden

[21] Appl. No.: 200,497

[22] PCT Filed: Dec. 18, 1979

[86] PCT No.: PCT/SE79/00253

§ 371 Date: Aug. 8, 1980

§ 102(e) Date: Aug. 8, 1980

[87] PCT Pub. No.: WO80/01297

PCT Pub. Date: Jun. 26, 1980

[30] Foreign Application Priority Data

Dec. 19, 1978 [SE] Sweden ..... 7813012
Feb. 28, 1979 [SE] Sweden ..... 7901795

[51] Int. Cl.[3] ..... E04C 2/24
[52] U.S. Cl. ..... 52/694; 52/642
[58] Field of Search ..... 52/639–644, 52/690–695, 741

[56] References Cited

U.S. PATENT DOCUMENTS

| | | | |
|---|---|---|---|
| 2,421,197 | 5/1947 | Green | 52/694 X |
| 3,019,491 | 2/1962 | Troutner | 52/694 X |
| 3,452,502 | 7/1969 | Price | 52/693 |
| 3,592,717 | 7/1971 | Gaughran | 52/642 X |
| 3,813,842 | 6/1974 | Troutner | 52/693 |
| 4,159,606 | 7/1979 | Kindberg | 52/694 X |

FOREIGN PATENT DOCUMENTS

| | | | |
|---|---|---|---|
| 1609571 | 3/1970 | Fed. Rep. of Germany . | |
| 1817718 | 6/1970 | Fed. Rep. of Germany . | |
| 2162323 | 1/1973 | Fed. Rep. of Germany | 52/693 |
| 2138074 | 2/1973 | Fed. Rep. of Germany . | |
| 2742202 | 3/1978 | Fed. Rep. of Germany . | |
| 1337792 | 4/1963 | France . | |
| 2373651 | 7/1978 | France . | |
| 139800 | 3/1953 | Sweden . | |

*Primary Examiner*—J. Karl Bell
*Attorney, Agent, or Firm*—Burns, Doane, Swecker & Mathis

[57] ABSTRACT

The present invention relates to a truss of the lattice type. The truss comprises an upper and lower chord of wood and a continuous web of steel in a zig zag configuration arranged between the chords to form inclined struts. The bent portions of the web are received in recesses in the chords and fastened in the recesses by a hardening and binding substance which forms a body which replaces wood removed to form the recesses.

8 Claims, 11 Drawing Figures

TRUSS OF LATTICE TYPE

The present invention relates to a truss of lattice type, comprising an upper and a lower chord and between the chords inclined struts fastened to the chords in a zig zag pattern. The chords are often made of wood and the struts of metal and the invention aims specifically to problems that arise in connection with this type of truss.

In earlier trusses of this type the struts are attached to the chords by clamping means or by other fastening means which are adapted to enter into the wood material as screws or nails. These fastening means have certain disadvantages, one of them being that the joint between the struts and chords of wood becomes weakened when the wood dries and shrinks. In case of varying loads there is furthermore the risk that a play arises in the joints. These disadvantages are serious in that the strength of the truss may become substantially lower than calculated, the result being unexpected failures.

The invention aims at a solution of these problems in that the struts enter into recesses in the chords and are fastened in these recesses by a hardening and adhering material which fills out the space around the struts within the recesses.

By this arrangement the weakening of the chords by the recesses for connecting the struts is compensated by the filling material. Secondly is achieved a fixing of the joint between the struts and the chords, so that the strength of the joint is not lessened in course of time by drying of the wood and no play is allowed to be initiated because the joint is subjected only to resilient deformations.

As joining material a hardening material which also should adhere both to the wood in the chords and the metal in the struts is preferably used. The strength of the material itself and of the joints therebetween and the components must of course be sufficient for resisting occurring forces. This means that in general the joining material must have the same compressive and tensile strength as the material in the chords and in the struts. Suitable adhering materials can be polyurethane plastic and epoxy glue.

BRIEF DESCRIPTION OF THE DRAWINGS

Closer details of the invention appear from the following specification with appended drawings wherein like members bear like reference numerals and wherein.

DETAILED DESCRIPTION OF THE PREFERRED EMBODIMENTS

Figure 1:
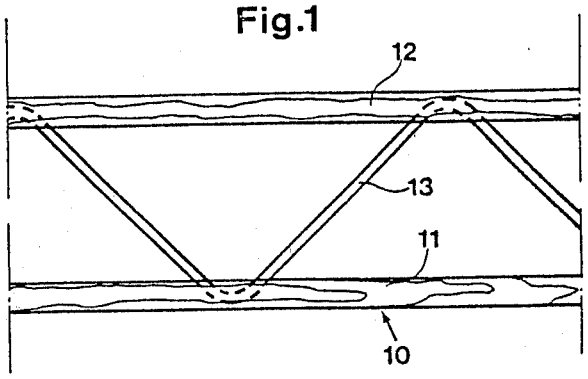
FIG. 1 is a side view of a truss according to the invention.
Figure 2:
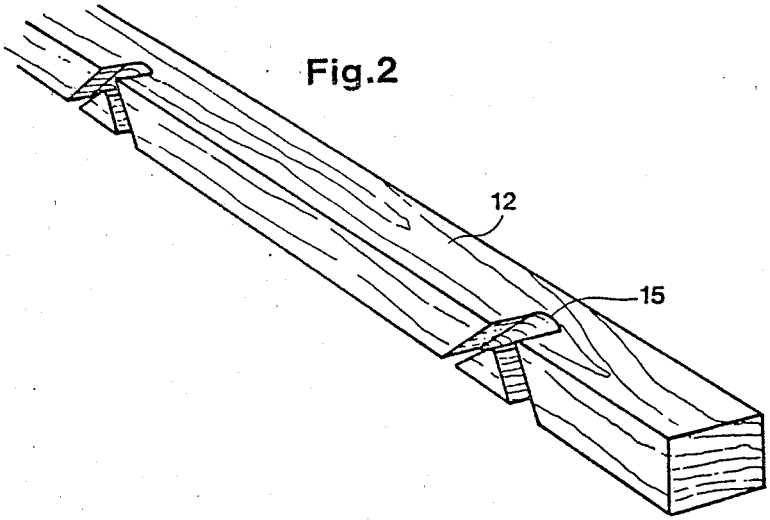
FIG. 2 is a perspective view of a separate chord according to the invention.
Figure 3:
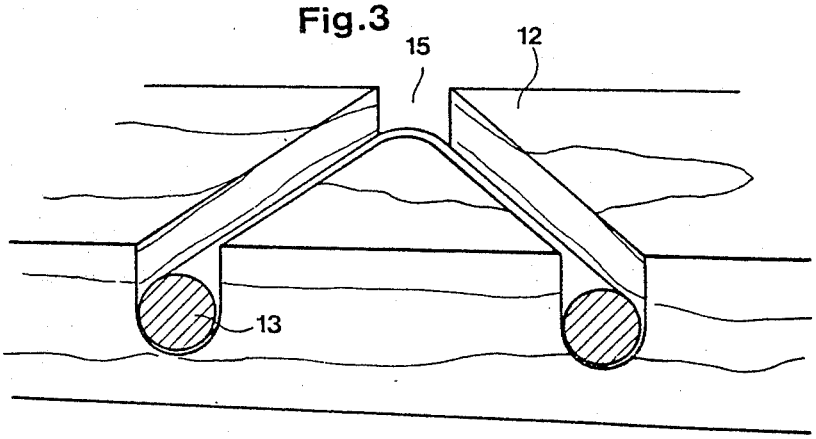
FIG. 3 is a detail in perspective of a joint for the struts.
Figure 4:
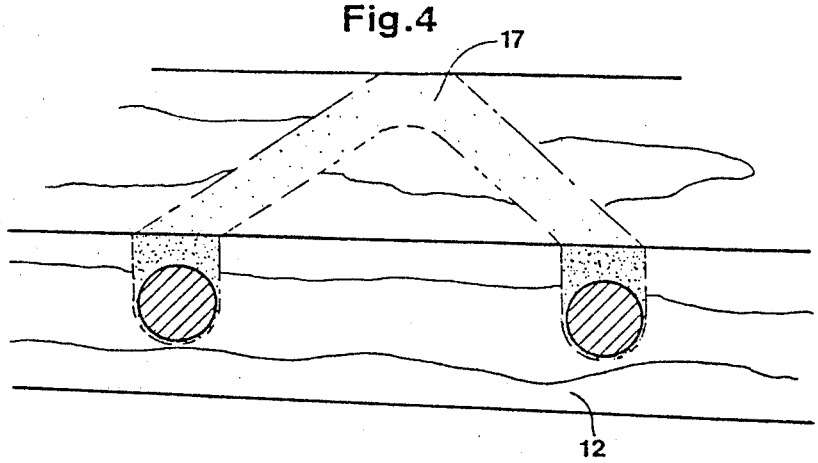
FIG. 4 is the same detail as in FIG. 3 but with joining material in the joint.

In FIG. 1, a truss 10 according to the invention comprises chords or flanges 11 and 12 of wood and a web in the form of inclined struts 13 of metal, suitably steel. The struts can be tubular or solid and they can form a continuous zig zag shaped bar as shown in FIG. 1. Possible joints in this bar are placed at the places where the web is countersunk into the chords. With reference to FIG. 2, a separate chord 12 includes recesses 15 for the struts 13. FIG. 3 shows in perspective a detail of how the bent portion 16 between two struts in a continuous zig zag bar 13 is inserted in a recess 15. FIG. 4 shows the same view as FIG. 3 but with the joint filled with binding material 17.

Figure 5:
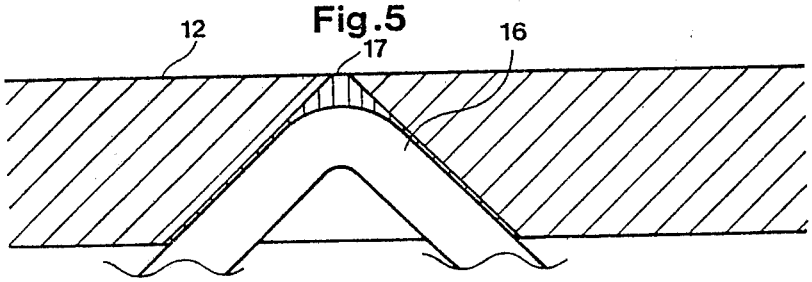
FIG. 5 is a side view of the joint.

With reference to FIG. 5, the curved intermediate portion 16 is placed between two struts in a continuous zigzag bar at a certain depth below the upper surface of the upper chord 12, so that the binding material 17 covers the portion 16 which firstly improves the strength and secondly improves the heat insulation between the struts and the upper side of the truss. The above is of course also valid for the joints in the lower chord 11 in relation to the lower side thereof.

Figure 6:
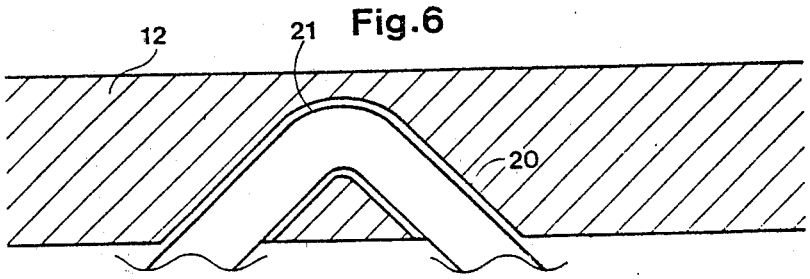
FIG. 6 is a second embodiment of the joint.

FIG. 6 shows another embodiment of the recesses where the top 21 of the recess 20 lies below the upper surface of the chord 12. The recess 20 can suitably be machined with a shank-end mill, which can have a plane end or a rounded end depending on what shape the bottom of the recess 20 is supposed to have. The shape can suitably be the same as the shape of the strut, for instance a rounded bottom for a strut having a round section. Also the recess 15 (FIGS. 2 and 3) can be made with a shank-end mill but can alternatively be made with a straight saw.

Figure 7:
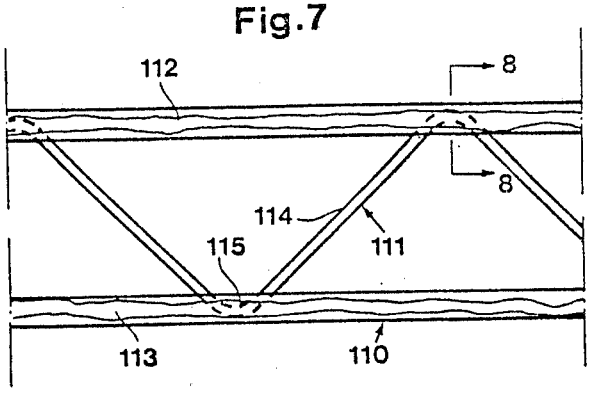
FIG. 7 is a view of a girder with joints according to a third embodiment of the invention.

FIGS. 7 to 11 show a further embodiment of the invention. The view in FIG. 7 is similar to the one in FIG. 1 but the sections in FIGS. 8 to 11 are different. The reference numbers are also different. The truss 110 comprises a zigzag bent bar 11 forming inclined struts 114 between two chords, one upper chord 112 and one lower chord 113. The bar 111 is bent in zigzag form from a bar, a strip or similar and comprises straight portions 114, which form struts in the girder, and bent portions 115 which enter into recesses 116 in the chords.

Figure 8:
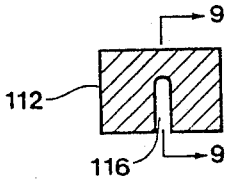
FIG. 8 is a section on a larger scale on the line 8—8 in FIG. 7 showing the chord without the struts.
Figure 9:
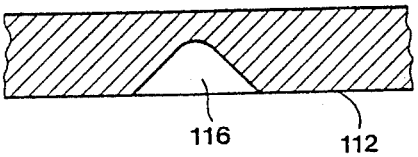
FIG. 9 is a section on the line 9—9 in FIG. 8.
Figure 10:
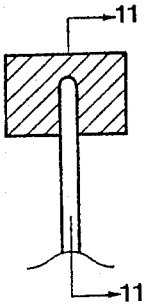
FIG. 10 is the same section as in FIG. 8 showing both the chord and the struts.
Figure 11:
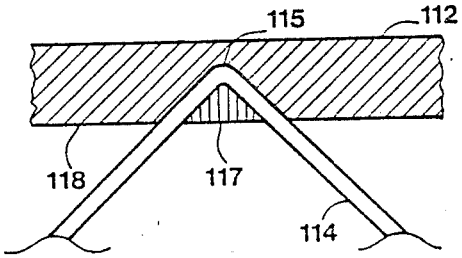
FIG. 11 is a section on the line 11—11 in FIG. 10.

FIG. 8 shows the upper chord 112 in cross section on the line 8—8 in FIG. 7 with the bar 111 removed, and FIG. 9 shows the same portion in longitudinal section on the line 9—9 in FIG. 8. In FIGS. 8 and 9 the bar 111 has been removed in order to illustrate the recess 116 more clearly.

The web or strut bar 111 is attached to the chords 112 and 113 by inserting the curved portions 115 into the recesses 116 and filling the space between the bar 111 and the recess 116 with a binding substance 117. In the finished joint illustrated in FIGS. 10 and 11 the recess 116 is filled with the fastening substance which surrounds the curved portion and fills the recess 116 up to level with the inside 18 of the chord 112, and correspondingly for the lower chord 113. The fastening material is also in this case a suitable hardening and binding substance, for instance polyurethane plastic (resin) or epoxy glue.

In the embodiment in FIGS. 7 to 11 the recesses 116 are open only towards the inside of the chords and form a slit in the inside surface. An advantage of this arrangement is that as little as possible is removed from the wood in the chords, the pocket formed by the recess gives a firm fastening of the glue joint and said pocket also forms a seat for the portion 115 which facilitates the assembling of the components before applying the glue 117.

The principles and preferred embodiments of the present invention have been described in the foregoing specification. However, the invention which is intended to be protected is not to be construed as limited to the particular embodiment disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the appended claims be embraced thereby.

What is claimed is:

1. A truss of lattice type comprising an upper and a lower chord of wood material, a continuous web of steel in a generally zig zag configuration arranged between the chords and forming inclined struts, bent portions of the web being countersunk into recesses in the chords, said bent portions being fastened in the recesses by a hardening and binding substance which forms a layer replacing wood material removed to form the recesses, said substance having a strength at least equal to the strength of the wood material of said chords.

2. A truss of lattice type comprising an upper and a lower chord of wood, a continuous web of steel in a generally zig zag configuration arranged between the chords and forming inclined struts, bent portions of the web being countersunk into recesses in the chords, said recesses leaving a volume of space both adjacent the bent portions and within the outer surfaces of said chords, said bent portions being secured in the recesses primarily by a hardening and binding substance, said substance forming a body substantially filling said volume of space and replacing wood removed to form the recesses, said body substantially encasing the bent portions of the web.

3. The truss as defined in claim 1 or 2, wherein the recesses in the chords are open only on an inside surface of the chords facing the axes of the struts.

4. The truss as defined in claim 1 or 2, wherein the hardening and binding substance is polyurethane.

5. The truss as in claim 1 or 2, wherein each of the recesses extends through an entire width of a side wall surface of each of the chords.

6. The truss as in claim 1 or 2, wherein the hardening and binding substance is epoxy glue.

7. The truss as in claim 3, wherein each of the recesses comprises a single opening in the respective chord.

8. The truss as in claim 2, wherein said hardening and binding substance has a strength at least equal to the strength of the wood of said chords.

* * * * *